United States Patent [19]

Kusumoto et al.

[11] Patent Number: 4,881,104

[45] Date of Patent: Nov. 14, 1989

[54] IMAGE FORMING APPARATUS HAVING A PLURALITY OF FEED OPENINGS

[75] Inventors: Keiji Kusumoto; Kenzo Nagata, both of Osaka, Japan

[73] Assignee: Minolta Camera Kabushiki Kaisha, Osaka, Japan

[21] Appl. No.: 184,621

[22] Filed: Apr. 22, 1988

[30] Foreign Application Priority Data

| | | | |
|---|---|---|---|
| Apr. 24, 1987 | [JP] | Japan | 62-102876 |
| Apr. 24, 1987 | [JP] | Japan | 62-102877 |
| Apr. 24, 1987 | [JP] | Japan | 62-102878 |
| Apr. 24, 1987 | [JP] | Japan | 62-102879 |
| Apr. 24, 1987 | [JP] | Japan | 62-102880 |
| Apr. 24, 1987 | [JP] | Japan | 62-102881 |

[51] Int. Cl.[4] ..... G03G 15/00

[52] U.S. Cl. ..... 355/309; 355/316; 355/317; 355/321; 271/9; 271/256

[58] Field of Search ..... 358/3 SH, 14 SH, 3 R, 358/14 R, 56; 271/3, 8 R, 9, 152, 153, 256

[56] References Cited

U.S. PATENT DOCUMENTS

| | | | |
|---|---|---|---|
| 4,054,380 | 10/1977 | Donohue et al. | 355/14 R |
| 4,222,660 | 9/1980 | Furuichi et al. | 355/14 R |
| 4,506,974 | 3/1985 | Sugiura et al. | 355/14 R |
| 4,545,668 | 10/1985 | Zaitsu | 355/3 R |
| 4,575,227 | 3/1986 | Ito et al. | 355/56 |
| 4,580,890 | 4/1986 | Sugizaki et al. | 355/14 SH |
| 4,624,546 | 11/1986 | Fukushi et al. | 355/14 R |
| 4,663,722 | 5/1987 | Sato | 271/9 X |
| 4,693,459 | 9/1987 | Shimoda et al. | 271/9 |
| 4,724,460 | 2/1988 | Shinyashiki | 355/14 SH |

*Primary Examiner*—A. C. Prescott

*Attorney, Agent, or Firm*—Burns, Doane, Swecker & Mathis

[57] ABSTRACT

When paper jam occurs during copy operation, the paper feed opening (which is one of the paper feed openings 1*a* to 1*d*) in which the paper jam occurs is determined, and thus, the number of occurrences of paper jam is counted for each of the paper feed openings. When the number of occurred times of paper jam exceeds a predetermined number, the paper feed opening concerned is forbidden to be used until maintenance or other repair work is completed. If the preferred feed opening (1*a*) assigned the first priority is forbidden to be used, another preferential feed opening is selected based on the numbers of occurred times of paper jam in the other paper feed openings (1*b* to 1*d*). On the other hand, when paper jam occurs, a paper jam occurrence ratio is calculated for each paper feed opening based on the number of sheets and the number of occurred times of paper jam counted. Based on the result of the calculation, control operation for selecting the paper feed openings (1*a* to 1*d*) including the preferential one is performed.

52 Claims, 18 Drawing Sheets

IMAGE FORMING APPARATUS HAVING A PLURALITY OF FEED OPENINGS

BACKGROUND OF THE INVENTION

1. Field of the Invention

The present invention relates to an image forming apparatus, such as a copying machine or a printer, having a plurality of feed openings, and particularly to an image forming apparatus which uses any of the feed openings as a preferential feed opening, assigned priority in selection among them.

2. Description of the Prior Art

An image forming apparatus such as a copying machine, having a plurality of feed openings is generally designed such that a specified feed opening is always set first at the time of turn-on of a main switch or automatic resetting.

A cassette containing sheets of paper of the most frequently used size is usually attached to such specified feed opening, i.e., the preferential feed opening. Accordingly, such design is convenient for use since paper sheets of a frequently used size (for example, the A4 size or the B4 size) are enabled to be automatically fed.

However, the preferential feed opening in a conventional image forming apparatus such as a copying machine is fixedly set and accordingly a transport system for transporting paper from the preferential feed opening to an image forming portion tends to be excessively used. As a result, feed rollers or the like for the preferential feed opening would be worn out quickly and paper jam in that transport system would occur frequently. Thus, convenience provided by setting of the preferential feed opening causes rather adverse influence and the preferential feed opening becomes inconvenient to the user on the contrary.

In addition, it happens that paper jam also occurs frequently in other feed openings than the preferential feed opening due to any trouble in the transport system concerned or the like. In such feed opening liable to cause paper jam is continuously used, paper jam occurs frequently, which causes great inconvenience.

In order to avoid jam of paper of a frequently used size, a cassette containing paper sheets of the frequently used size may be attached to a feed opening other than a preferential feed opening. However, such a method increases the number of operations required for changing feed openings, for example, pressing of a paper size selection button or the like each time in the initial mode, which causes inconvenience to the user and also causes erroneous operation of a print switch as a result of erroneous designation of a paper size.

On the other hand, an image forming apparatus such as a copying machine, provided with a plurality of feed openings and a feed opening selection switch of a rotation system for successively selecting the feed openings in the order of priority, is generally adapted to have the above stated order of priority fixedly determined. Such an apparatus is designed so that a feed opening assigned a first priority is automatically set at first when a main switch is turned on or automatic resetting is effected. In this case, the same disadvantages as in the preferential feed opening in the above described image forming apparatus are involved in the feed opening assigned the first priority.

SUMMARY OF THE INVENTION

An object of the present invention is to provide an image forming apparatus capable of effectively using a preferential feed opening.

Particularly, the object of the present invention is to provide an image forming apparatus in which a preferential feed opening is not fixed.

More particularly, the object of the present invention is to provide an image forming apparatus which assigns an order of priority to feed openings to determine a preferential feed opening among them.

In order to accomplish the above described object, the image forming apparatus in an aspect of the present invention comprises: a plurality of paper feed means for feeding sheets of paper; image forming means for forming an image on the sheet fed by said paper feed means; counting means for counting the number of erroneous feeding operations occurring in each of the paper feed means; first selection means for manually selecting any one of the paper feed means; forbidding means for forbidding the first selection means to select the paper feed means in which the number of erroneous feeding operations counted by the counting means exceeds a predetermined number; designation means for designating the paper feed means having the smallest number of erroneous feed operations out of the paper feed means, the selection of which is not forbidden by the forbidding means, each time the forbidding means is operated; initialization signal generating means; and second selection means responsive to the initialization signal from the initialization signal generating means, for selecting the paper feed means designated by the designation means.

In order to accomplish the above described object, the image forming apparatus in another aspect of the present invention comprises: a plurality of paper feed means for feeding sheets of paper; image forming means for forming an image on the sheet fed by the paper feed means; calculation means for calculating a ratio of occurrence of erroneous feeding operations for each of the paper feed means; first selection means for manually selecting any one of the paper feed means; forbidding means for forbidding the first selection means to select the paper feed means in which the ratio of occurrence of erroneous feeding operations calculated by the calculation means exceeds a predetermined ration; designation means for designating the paper feed means having the smallest ratio of occurrence of erroneous feeding operations out of the paper feed means the selection of which is not forbidden by the forbidding means, each time the forbidding means is operated; initialization signal generating means; and second selection means for selecting the paper feed means designated by the designation means, in response to the initialization signal from the initialization signal generating means.

In the image forming apparatus thus constructed, the preferential feed opening can be changed by taking account of the occurrence of erroneous feeding operations and accordingly it becomes possible to efficiently utilize the preferential feed opening and to reduce occurrences of erroneous feeding operations in the preferential feed opening.

Another object of the present invention is to provide an image forming apparatus including a feed opening selection switch of a rotation system, which is capable of effectively utilizing a preferential feed opening.

Particularly, the object of the present invention is to provide an image forming apparatus in which an order of preference for selection of feed openings is not fixed.

More particularly, the object of the present invention is to provide an image forming apparatus in which a preferential feed opening is determined based on a changed order of preference.

In order to accomplish the above described object, the image forming apparatus in an aspect of the present invention comprises a plurality of paper feed means for feeding sheets of paper; image forming means for forming an image on the sheet fed by the paper feed means; counting means for counting the number of erroneous feeding operations occurring in each of the paper feed means; manual switch means for manually generating a switch signal; selection means for successively selecting the paper feed means according to a predetermined order, in response to an output of the manual switch means; and control means for changing the predetermined order based on a count value of the counting means.

In order to accomplish the above described object, the image forming apparatus in another aspect of the present invention comprises: a plurality of paper feed means for feeding sheets of paper; image forming means for forming an image on the sheet fed by the paper feed means; calculation means for calculating a ratio of occurrence of erroneous feeding operations occurring in each of the paper feed means; manual switch means for manually generating a switch signal; selection means for successively selecting the paper feed means according to a predetermined order, in response to an output of the manual switch means; and control means for changing the predetermined order based on a calculated value of the calculation means.

The image forming apparatus thus constructed changes an order of preference to set a preferential paper feed opening by taking account of the occurrence of erroneous feeding operations of each opening and accordingly it becomes possible to effectively utilize the preferential feed opening and to reduce occurrences of erroneous feeding operations in the preferential feed opening.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
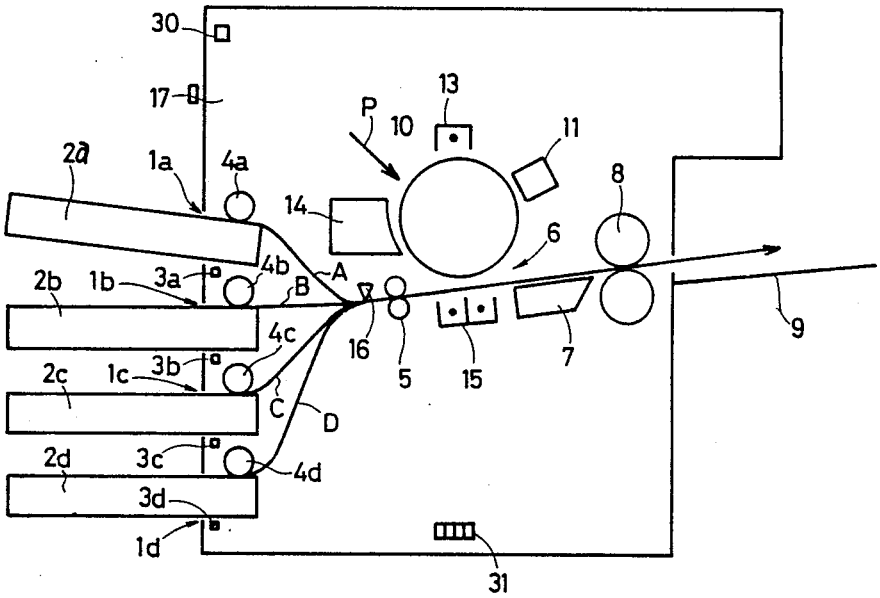
FIG. 1 is a schematic sectional view showing a copying apparatus according to an embodiment of the present invention, in which a plurality of paper feed openings are provided on a side face of a main body of the apparatus.

FIG. 1 is a schematic view showing a construction of a copying apparatus having a plurality of feed openings according to an embodiment of the present invention.

The construction will be described hereinafter with reference to the drawing. A main body of the copying apparatus has a side face including a first paper feed opening 1*a*, a second paper feed opening 1*b*, a third paper feed opening 1*c* and a fourth paper feed opening 1*d* in the order beginning with the first opening as the uppermost one. Cassettes 2*a*, 2*b*, 2*c* and 2*d* of different sizes are inserted in the first to fourth feed openings, respectively. Those cassettes contain paper sheets of the A3 size, the A4 size, the B4 size and the B5 size for example. Each cassette can be attached to an arbitrary one of the feed openings. The paper sizes of the cassettes attached to the respective feed openings 1*a*, 1*b*, 1*c* and 1*d* are detected by the paper size detection sensors 3*a*, 3*b*, 3*c* and 3*d*, respectively, and stored in a control portion.

The sheets in the cassettes 2*a*, 2*b*, 2*c* and 2*d* are delivered through feed rollers 4*a*, 4*b*, 4*c* and 4*d*, respectively, and transported through intermediate transport rollers (not shown), timing rollers 5, an image forming portion 6, a transport portion 7 and fixation rollers 8 so as to be discharged on a discharge tray 9. There are provided four transport paths A, B, C and D from the respective cassettes 2*a*, 2*b*, 2*c* and 2*d*, respectively, to the timing rollers 5, corresponding to the respective cassettes. Any one of the paths is selected for copy operation.

The image forming portion 6 is provided with a photoreceptor drum 10, a cleaning unit 11, a corona charger 13, a developing unit 14, a transfer-separation charger 15 and the like. Light P reflected from a document is applied to the photoreceptor drum 10 by means of an optical system not shown, whereby an electrostatic latent image is formed on the drum 10. The electrostatic latent image is caused to be a toner image when toner supplied from the developing unit 14 is applied thereto. Then, the toner image is transferred onto the paper by means of the transfer-separation charger 15, so that a visible image is formed on the paper.

A paper detection sensor 16 is provided upstream of the timing rollers 5, so as to detect paper jam and to control paper timing or the like. Although various methods may be used to detect paper jam, this embodiment adopts a method in which paper jam is detect dependent on determination as to whether a leading edge of a paper sheet attains the paper detection sensor 16 within a predetermined period after start of any of the feed rollers 4a, 4b, 4c and 4d. In other words, it is determined that paper jam occurs when the paper detection sensor 16 is not turned on within the predetermined period. Since the control portion stores the feeding of the actually used one of the feed openings 1a, 1b, 1c and 1d, determination is also made simultaneously as to in which of the feed openings 1a, 1b, 1c and 1d paper jam occurs.

In addition, the number of sheets fed from each feed opening can be counted. This data is stored in a RAM 24, described later, of the control portion.

A forbidden state cancel switch 17 to be pressed for repair by a serviceman for example is provided on the side face of the main body. Pressing of this switch 17 cancels the state in which use of any of the feed openings 1a, 1b, 1c and 1d has been forbidden. A preference designation switch 31 provided in a lower portion of the main body is used to designate a preferential feed opening at the time of shipment from a factory or inspection by a service man for example. If this switch is operated, the first feed opening for example is selected as a preferential feed opening. A main switch 30 provided in an upper portion of the main body is used to turn on power supply when the apparatus is to be used.

Figure 2:
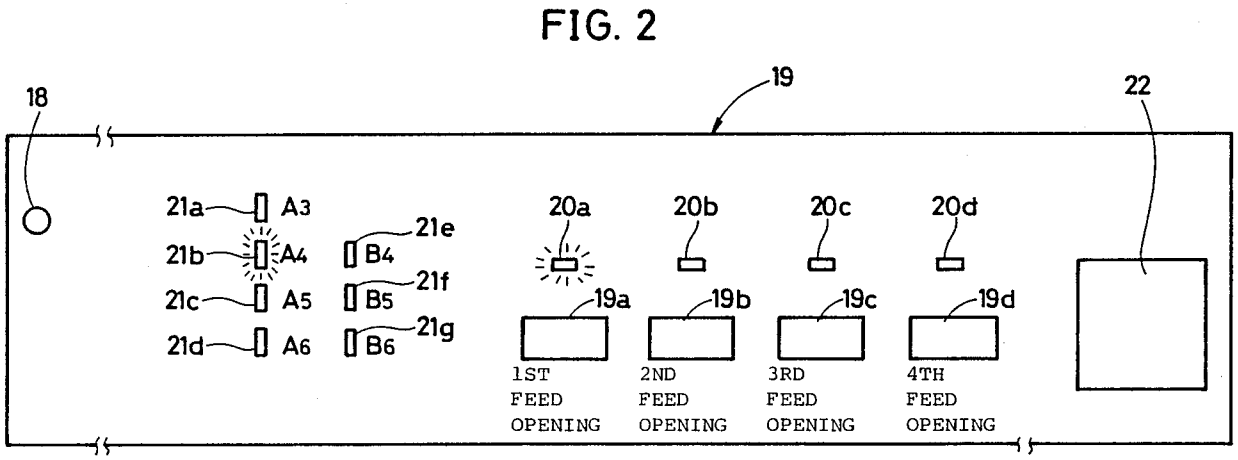
FIG. 2 is a plan view showing a part of an operation panel of the copying apparatus of the embodiment shown in FIG. 1.

FIG. 2 shows a part of an operation panel 19. The operation panel 19 includes feed opening selection keys 19a, 19b, 19c and 19d. When any of the keys is pressed, the corresponding one of the feed openings 1a, 1b, 1c and 1d shown in FIG. 1 can be selected. Display lamps 20a, 20b, 20c and 20d are provided corresponding to the respective keys to indicate which key is pressed. The operation panel 19 further includes paper size display lamps 21a to 21g for indicating any size of paper in the cassettes 2a, 2b, 2c and 2d attached to the thus selected feed openings 1a, 1b, 1c and 1d.

In the example of FIG. 2, the first feed opening 1a is selected and the display lamp 20a corresponding thereto is turned on with the paper size display lamp 21b being turned on to indicate supply of the A4-size paper from the first feed opening 1a. Thus, when the main switch 30 is turned on or the apparatus is automatically reset, the preferential feed opening is automatically selected (usually the first feed opening 1a is selected in a fixed manner in the prior art).

The operation panel shown in FIG. 2 further includes a print switch 22 and an alarm lamp 18 to be turned on to indicate that use of the feed opening concerned is forbidden.

Figure 3:
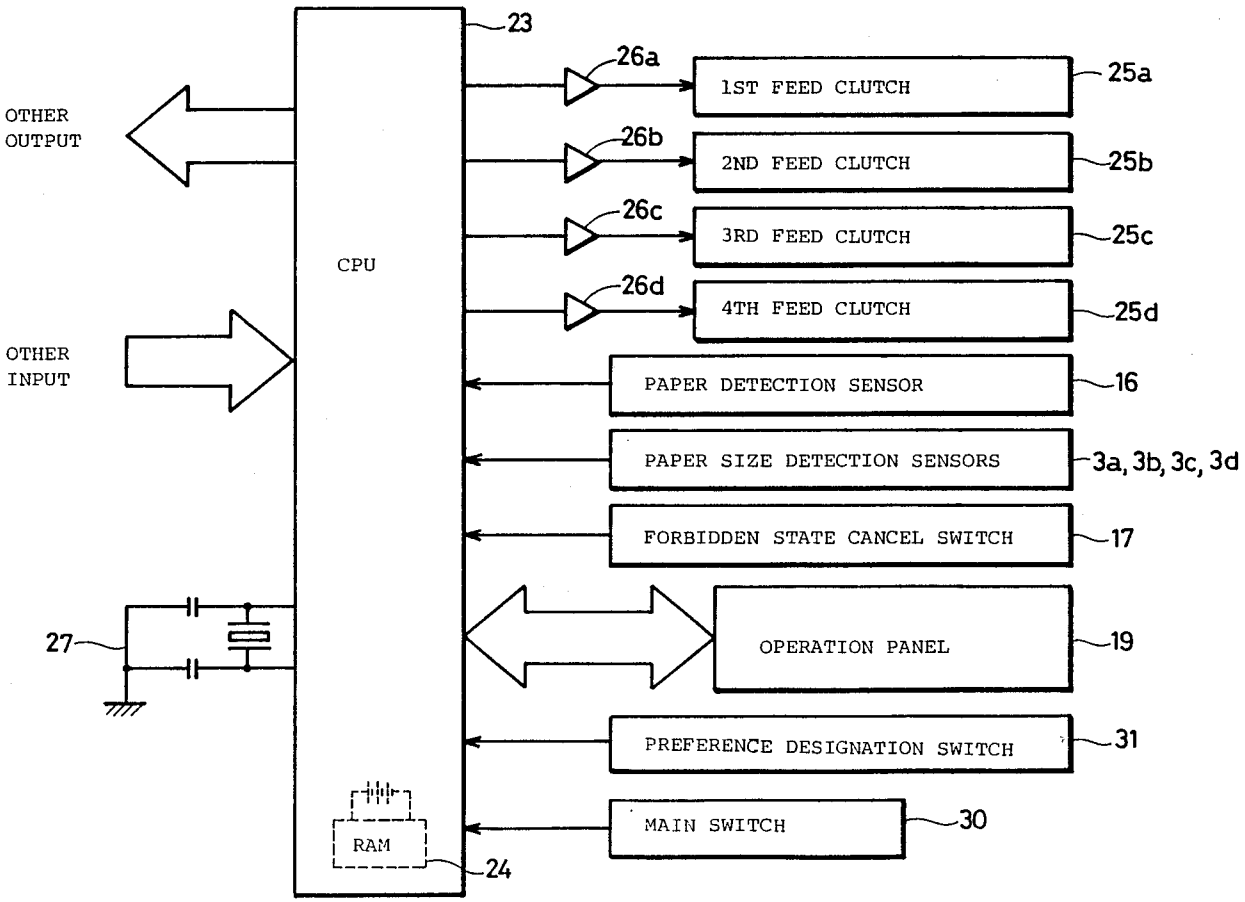
FIG. 3 is a schematic block diagram showing a control portion of the copying apparatus of the embodiment shown in FIG. 1.

FIG. 3 is a schematic block diagram showing a construction of the control portion. A central processing unit (CPU) 23 of the control portion is formed by a one-chip microcomputer and it comprises a RAM 24 having a backup battery. An output port of the CPU 23 is connected to drivers 26a, 26b, 26c and 26d for driving a first paper feed clutch 25a, a second paper feed clutch 25b, a third paper feed clutch 25c and a fourth paper feed clutch 25d, respectively. When one of the drivers is driven in response to an output signal of the CPU 23, the corresponding paper feed clutch is connected and the corresponding one of the feed rollers 4a, 4b, 4c and 4d is driven. For example, as shown in FIG. 2, if the first feed opening 1a is selected to supply paper sheets of the A4 size, the first paper feed clutch 25a is connected when the print switch 22 is pressed, so that the first feed roller 4a is driven.

An input port of the CPU 23 is connected to the paper detection sensor 16, the forbidden state cancel switch 17, the paper size detection sensors 3a, 3b, 3c and 3d, the preference designation switch 31, the main switch 30, and the like, so that signals from those components are inputted to the CPU 23. An input/output of the CPU 23 is connected to the switches and the display lamps of the operation panel 19. Input signals from the feed opening selection keys 19a, 19b, 19c and 19d, the print switch 22 and the like are applied to the CPU 23, while the display lamps 20a etc., the alarm lamp 18 and the like are operated in the prescribed manner in response to signals from the CPU 23. The CPU 23 is further connected with an oscillation circuit 27 for supplying a predetermined clock signal.

Figure 4:
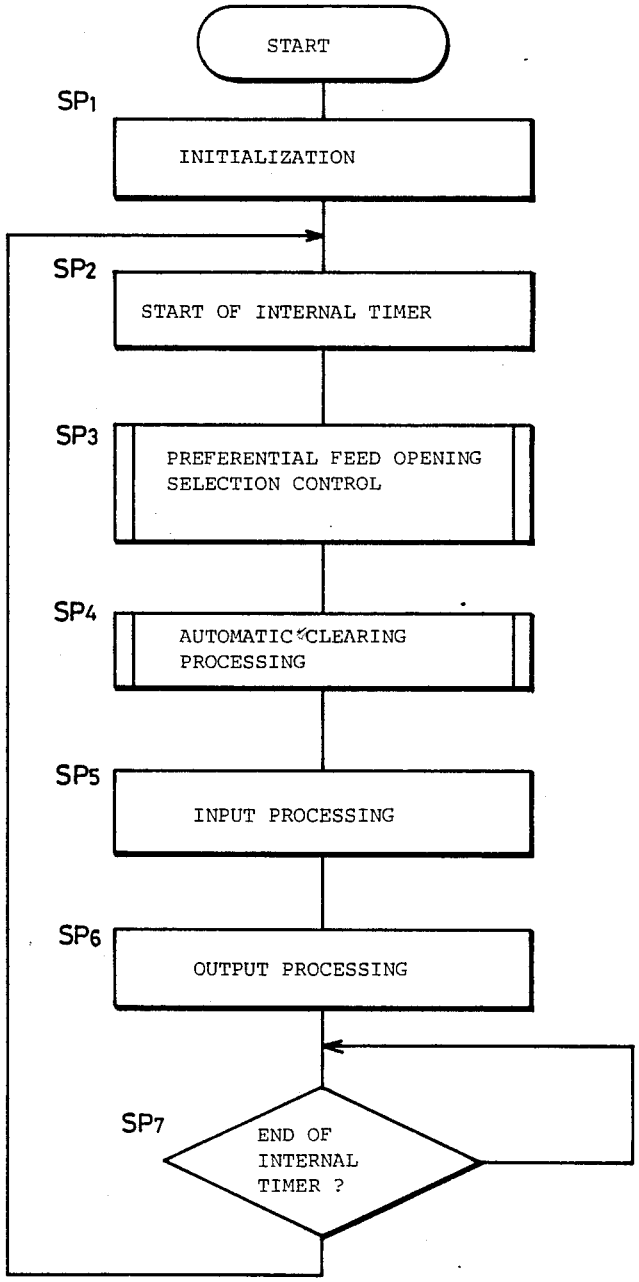
FIG. 4 is a flow chart showing a main routine of a control flow of the control portion in the embodiment shown in FIG. 1.

FIGS. 4 and 5 show control flows in the above described control portion.

FIG. 4 is a flow chart showing a main routine. The main routine is started at turn-on of the main switch 30 as a power switch and in the step SP1, initialization operations such as automatic setting of a preferential feed opening and setting of an internal timer value are executed. Then, in the step SP2, the internal timer set by the initialization is started and in the step SP3, preferential feed opening selection control operation is performed. In this preferential feed opening selection control, the feed opening in which the number of occurred times of paper jam exceeds a predetermined number is forbidden to be used based on paper jam occurrence number data for the respective feed openings 1a, 1b, 1c and 1d and the feed opening in which the number of occurred times of paper jam is the smallest is selected as a preferential feed opening. Details of this control will be described later with reference to FIGS. 5A, 5B and 5C.

The step SP 4 is related with automatic clearing processing for automatically selecting a preferential feed opening after an end of copy operation or the like, details of this processing being described later with reference to FIG. 6.

Further, in the steps SP5 and SP6, input processing and output processing for copy operation and the like are executed. Since those controls are well known and have no direct relation with the present invention, description thereof is omitted.

Subsequently, in the step SP7, it is determined whether the internal timer comes to an end or not. After the end of the internal timer, the processing flow returns to the step SP2. Thus, one cycle period of the main routine is defined by the internal timer and the main routine is repeatedly executed while the power supply is being turned on.

Figure 5A:
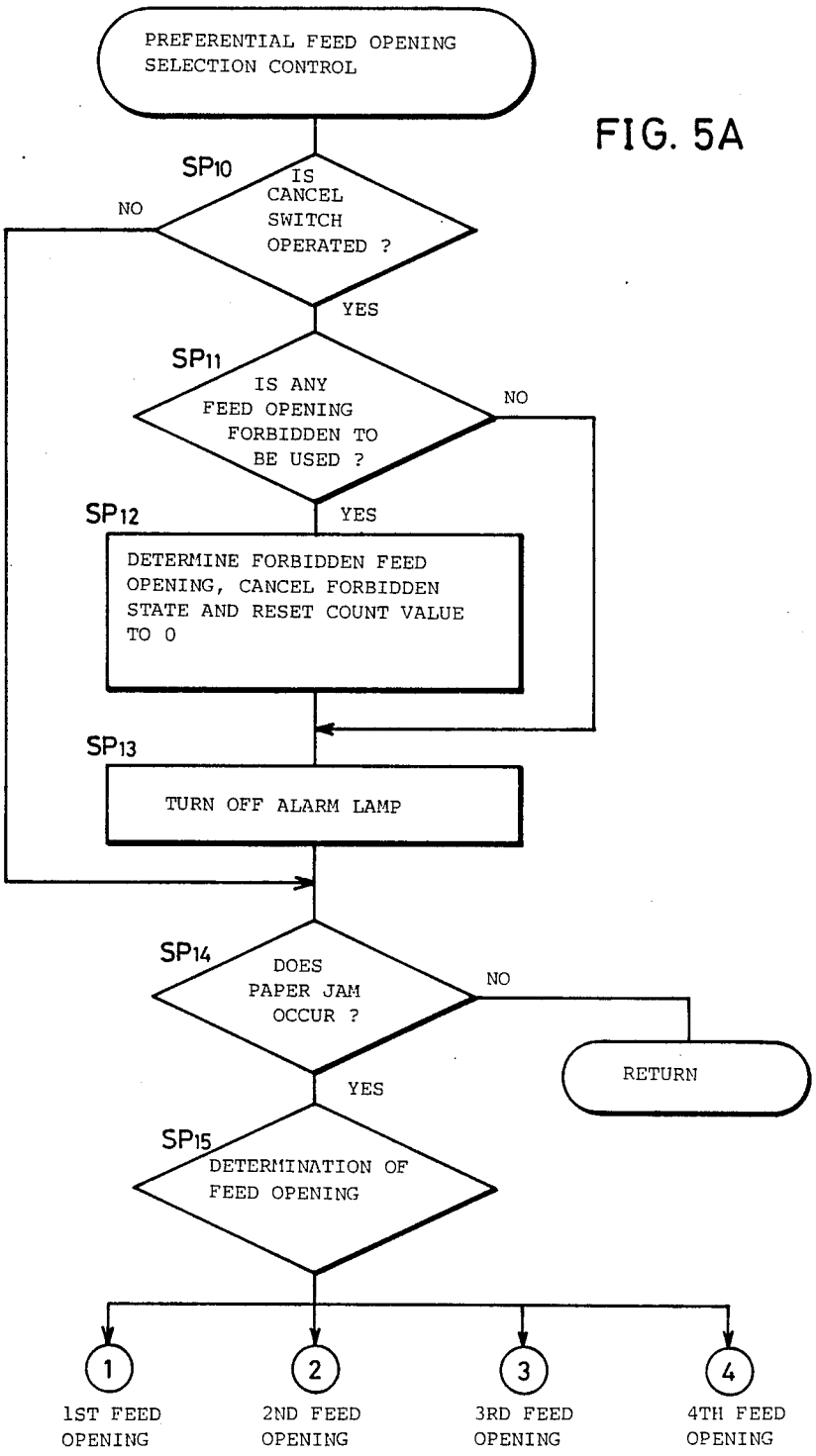
FIGS. 5A, 5B and 5C are flow charts showing subroutine for selection control of a preferential feed opening, this subroutine being a step of the main routine of the control portion in the embodiment shown in FIG. 1.
Figure 5B:
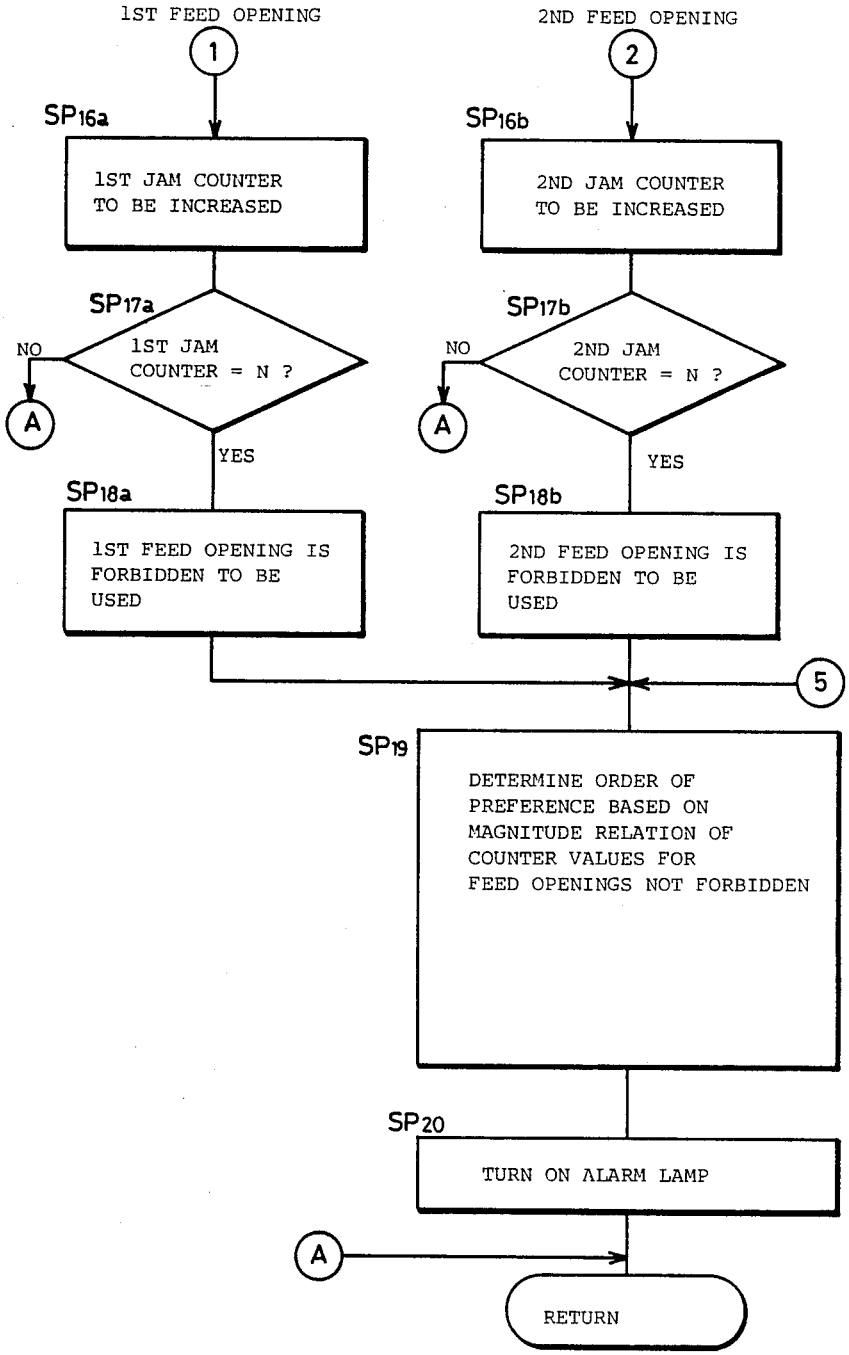
Figure 5C:
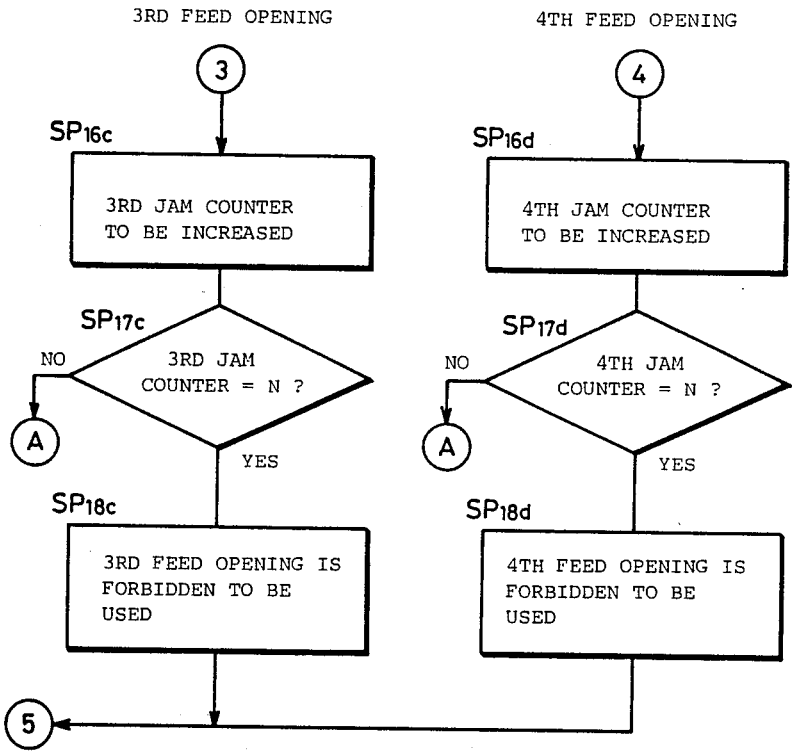

FIGS. 5A to 5C are flow charts showing a subroutine for the preferential feed opening selection control in the above described step SP3.

First, in the step SP10, it is determined whether the forbidden state cancel switch 17 is operated or not. If it is operated, the flow proceeds to the step SP11. If it is not operated, the flow jumps to the step SP14. In the step SP11, it is determined whether use of any feed opening is forbidden or not. If it is not forbidden, the flow jumps to the step SP 13. On the other hand, if it is forbidden, the flow proceeds to the step SP12 to determine the feed opening forbidden to be used, to cancel the forbidden state and to reset a jam count value corresponding thereto to 0. Then, in the step SP13, the alarm lamp 18 indicating the forbidden state of the feed opening is turned off and the flow proceeds to the step SP14. Thus, the forbidden state of the feed opening which was repaired by a serviceman for example is canceled and the jam count value thereof is reset to 0, whereby this feed opening is ready again to be used.

In the step SP14, it is determined whether paper jam occurs or not. If it does not occur, the flow returns to the main routine. If paper jam occurs, it is determined in the subsequent step SP15 in which feed opening the paper jam occurs.

If the feed opening in trouble is the first feed opening 1*a*, the procedures in the steps SP16*a* to SP18A are executed. Similarly, if the feed opening in trouble is the second feed opening 1*b*, the third feed opening 1*c*, or the fourth feed opening 1*d*, the procedures in the steps SP16*b* to SP18*b*, the steps SP16*c* to SP18*c*, or the steps SP16*d* to SP18*d*, respectively, are executed.

If it is determined that paper jam occurs in the first feed opening 1*a*, a first jam counter for counting the number of occurred times of paper jam in the first feed opening 1*a* is incremented in the step SP16*a* and the data is stored in the RAM 24 of the CPU 23. Then, in the step SP17*a*, it is determined whether the content of the first jam counter attains a predetermined number N (for example, 100) or not. If the content of the first jam counter is not N, the flow returns to the main routine and the subroutine is terminated. If the content of the first counter is N, it is determined that use of the first feed opening 1*a* is unsuitable thereafter, and use of the first feed opening 1*a* is forbidden in the step SP18*a*. Then, the flow proceeds to the step SP19. Processing for the first feed opening 1*b*, the third feed opening 1*c* and the fourth feed opening 1*d* is the same as described above and therefore description thereof is omitted.

In the step SP19, the jam count values of all the feed openings which are not forbidden to be used are called from the RAM 24 and an order of preference is assigned to the respective feed openings according to the magnitude relation of the values. More specifically, since a small jam count value represents a small number of occurred times of paper jam, priorities are assigned to the feed openings in the order beginning with the feed opening having the smallest number of occurred times of paper jam. If the feed openings have the same number of occurred times of paper jam, the priorities assigned thereto are based on an order of preference predetermined for the feed openings having the same number of occurred times of paper jam. Thus, the feed opening of the first priority is automatically selected as the preference feed opening in the initial mode. In the subsequent step SP20, processing for turning on the alarm lamp 18 is executed to indicate that the feed opening in which the number of occurred times of paper jam attains the predetermined number is forbidden to be used. Then, the flow returns to the main routine to terminate the subroutine.

In this embodiment, the common alarm lamp 18 is turned on when any of the feed openings 1*a*, 1*b*, 1*c* and 1*d* is forbidden to be used; however, an alarm lamp may be provided for each of the feed openings so as to clearly indicate which feed opening is actually forbidden to be used. In addition, although the forbidden state of the feed opening is indicated by turn-on of the alarm lamp 18 in the present embodiment, the alarm of the forbidden state may be given by a sound, e.g., by using a buzzer, or may be given by combination of the turn-on of the lamp and the issuance of the sound.

In the above described control, any of the feed opening 1*a*, 1*b*, 1*c* and 1*d* where the number of occurred times of paper jam becomes larger than the predetermined number is forbidden to be used and the first priority is assigned to the feed opening having the smallest number of occurred times of paper jam, as the preferential feed opening, which is automatically selected in the initial mode. However, it is not necessarily needed to set, as the preferential feed opening, the feed opening having the smallest number of occurred times of paper jam as in this embodiment. For example, the first feed opening 1*a* is at first set as the preferential feed opening and control may be exerted to select, as the next preferential feed opening, the second feed opening 1*b* unless it is forbidden to be used when use of the first feed opening 1*a* is forbidden and thereafter to select the third feed opening 1*c* and the fourth feed opening 1*d* successively as the preferential feed opening in the above described manner.

Figure 6:
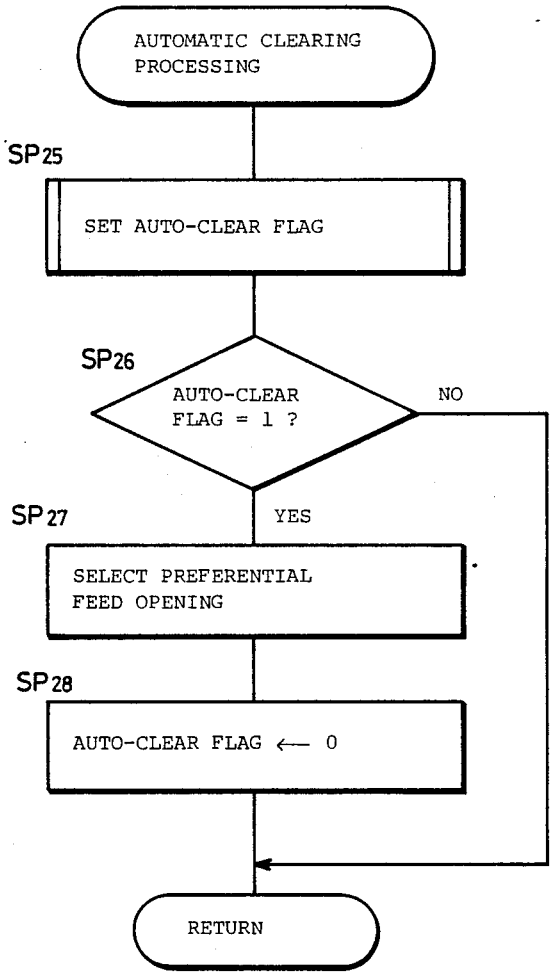
FIG. 6 is a flow chart showing a subroutine of automatic clearing processing, which is a step of the main routine of the control portion in the embodiment shown in FIG. 1.

FIG. 6 is a flow chart showing a subroutine of the automatic clearing processing of the above described step SP4.

First, in the step SP25 for setting an auto-clear flag, the auto-clear flag is set when the apparatus is left as it is for a predetermined period after an end of copy operation, or when the apparatus is left as it is for a predetermined period with the print key 22 being not pressed after input through any key of the operation panel 19. On the other hand, if there is no such lapse of the predetermined period, the auto-clear flag is not set. After the step SP25, it is determined in the step SP26 whether the auto-clear flag is set or not. If the flag is set (i.e., to 1), the flow proceeds to the step SP27 to select a preferential feed opening of the first priority. Then, the flag is reset (i.e., to 0) in the step SP28 and the flow returns to the main routine to terminate the subroutine. Thus, even if a feed opening other than the preferential feed opening is selected in this control, the preferential feed opening is automatically selected again under the given conditions. On the other hand, it is determined in the step SP26 that the flag is not set, the flow jumps the step SP27 and SP28 and returns to the main routine to terminate the subroutine. In the latter case, the selected feed opening is never changed.

The preferential feed opening selection control shown in FIG. 5 is based on the absolute number of occurred times of paper jam; however, control can be made more efficiently based on the paper jam occurrence ratio taking account of a relation with the number of sheets used. In such a manner, the number of occurred times of paper jam can be further reduced since worn states or other conditions of the feed rollers 4*a*, 4*b*, 4*c* and 4*d* and the like can be taken into consideration. In this connection, FIGS. 7A to 7C show a subroutine in another embodiment for exerting preferential feed opening selection control based on the paper jam occurrence ratio.

Figure 7A:
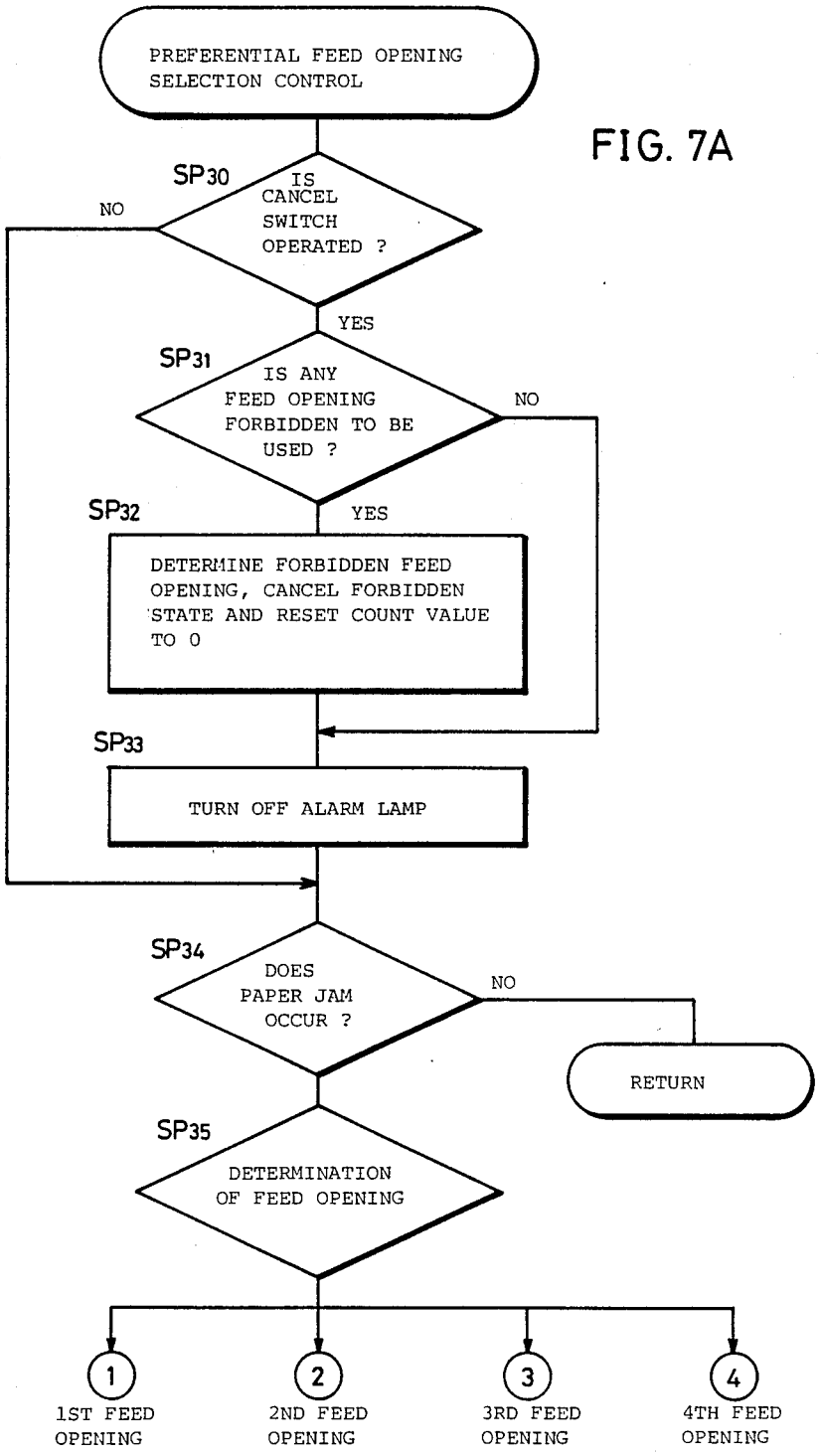
FIGS. 7A, 7B and 7C are flow charts showing subroutine for preferential feed opening selection control as a step of a main routine of a control portion in another embodiment of the present invention.
Figure 7B:
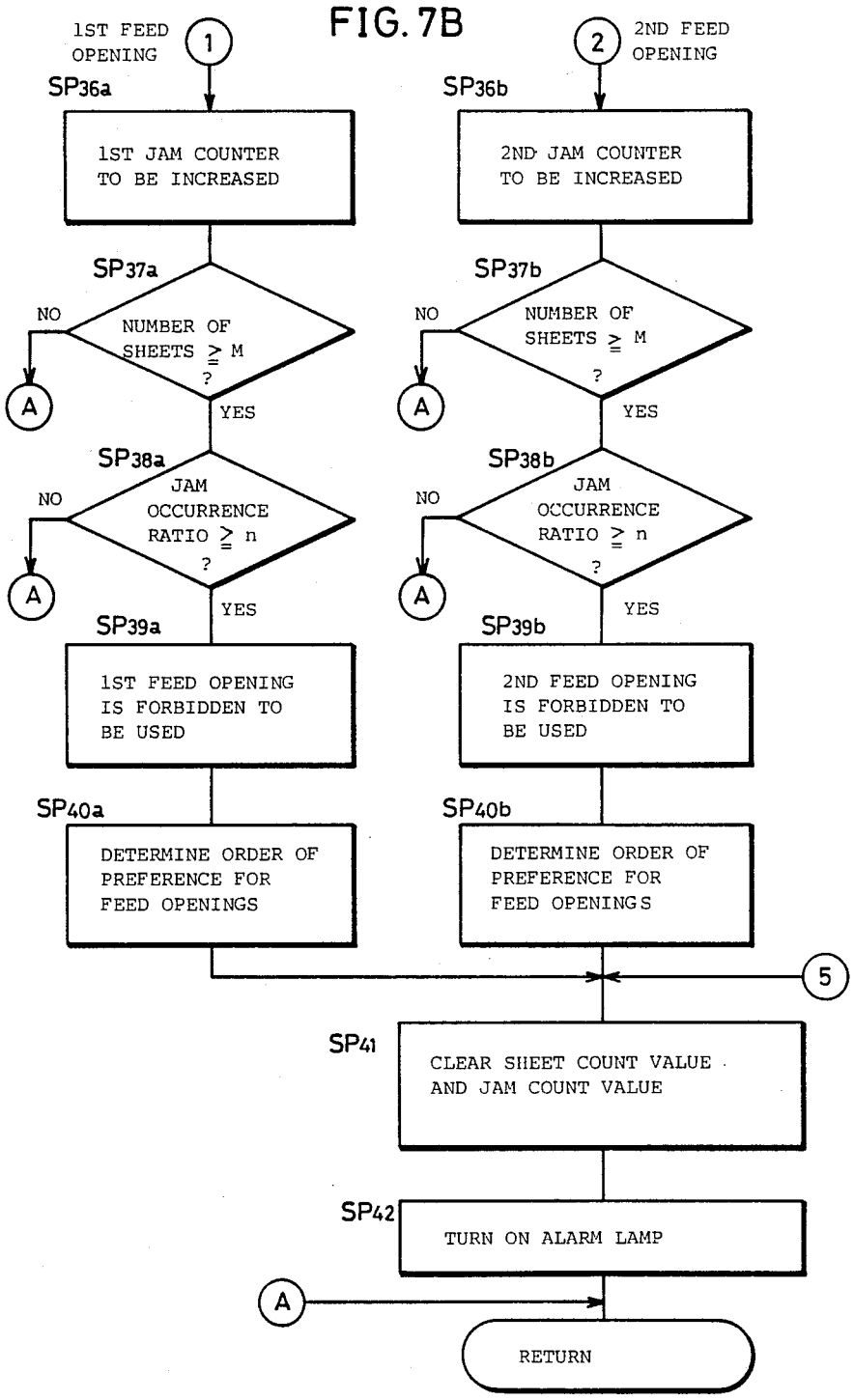
Figure 7C:
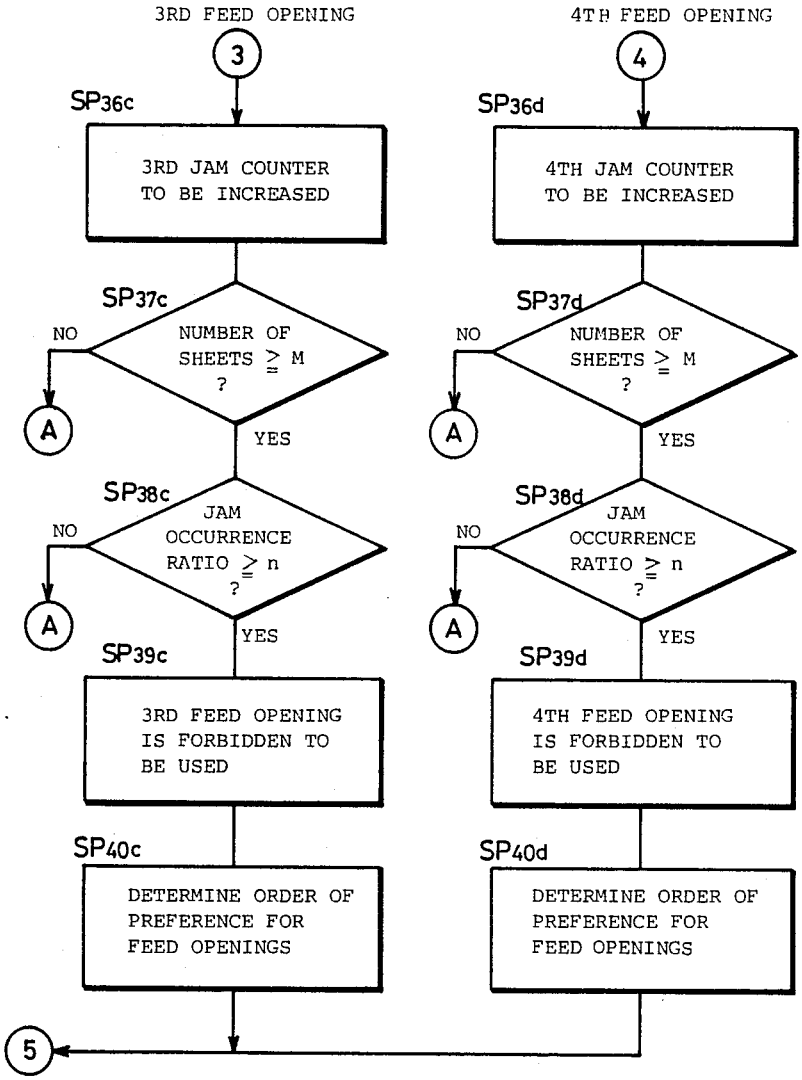

The steps SP30 to SP35 in the flow chart of FIG. 7A are the same as the steps SP10 to SP15 in the flow chart of FIG. 5A. When it is determined in the step SP35 that the feed opening where paper jam occurs is the first feed opening 1*a*, the steps SP36*a* to SP40*a* are executed. If the feed opening in trouble is the second feed opening 1*b*, the third feed opening 1*c* or the fourth feed opening 1*d*, the steps SP36*b* to SP40*b*, the steps SP36*c* to SP36*c*, or the steps SP36*d* to SP40*d* are executed.

When it is determined that paper jam occurs in the first feed opening 1*a*, the first jam counter is incremented in the step SP36*a* and then it is determined in the step SP37*a* whether the content of the first sheet counter for counting the number of sheets fed from the first feed opening 1*a* is larger than predetermined number M (for example, 200) or not. If the number of sheets fed does not attain M, the flow returns to the main routine to terminate the subroutine. If the number of sheets fed is equal to or larger than M, the flow proceeds to the step SP38*a* to determine whether the paper jam occurrence ratio equal to or larger than a predetermined value n or not. The paper jam occurrence ratio is obtained by division of the count value in the first jam counter (i.e., the number of occurred times of paper jam) by the count value in the first sheet counter (i.e., the number of sheets fed). If the paper jam occurrence ratio is smaller than the predetermined value n, the flow returns to the main routine to terminate the subroutine. If the paper jam occurrence ratio is equal to or larger than the predetermined value n, the flow proceeds to the step SP39*a* to forbid use of the first feed opening 1*a*. Then, in the step SP40*a*, the jam count values (i.e., the number of occurred times of paper jam) of the other feed openings 1*b*, 1*c* and 1*d* as well as the sheet count values thereof (i.e., the number of sheets fed) are called from the RAM 24, whereby the paper jam occurrence ratio for each feed opening is calculated in the same manner as described above and priorities are assigned to the second feed opening 1*b*, the third feed opening 1*c* and the fourth feed opening 1*d* based on the magnitude relation of the thus obtained values. If the paper jam occurrence ratio is small, this means that the possibility of occurrence of paper jam thereafter is small. Thus, the order of priority is determined by assigning the first priority to the feed opening having the smallest value. If the feed openings have the same jam occurrence ratio, the order is set based on a predetermined order for the feed openings having the same occurrence ratio.. Thus, the feed opening of the first priority is automatically selected as the preferential feed opening in the initial mode. Then, the flow proceeds to the step SP41. Since the processing for the second feed opening 1*b*, the third feed opening 1*c* and the fourth feed opening 1*d* is performed in the same manner, description thereof is omitted.

In the step SP41, the contents (the values) of all the jam counters and sheet counters are cleared (to 0) and initialization processing for detecting a paper jam occurrence ratio in the next cycle is executed. Then, in the step SP42, processing for turning on the alarm lamp 18 indicating that the use of the feed opening concerned is forbidden is executed and, after that, the flow returns to the main routine to terminate the subroutine.

FIGS. 5A to 5C and 7A to 7C show the subroutines in which the first to fourth jam counters are provided to count the numbers of occurred times of paper jam in the respective feed opening 1*a*, 1*b*, 1*c* and 1*d*, so that the preferential feed opening selection control is exerted. However, preferential feed opening selection control may be exerted in a manner in which the number of occurred times of paper jam is counted only for the feed opening designated as the preferential feed opening. The control in the latter case is advantageous in that only one jam counter is required.

Figure 8A:
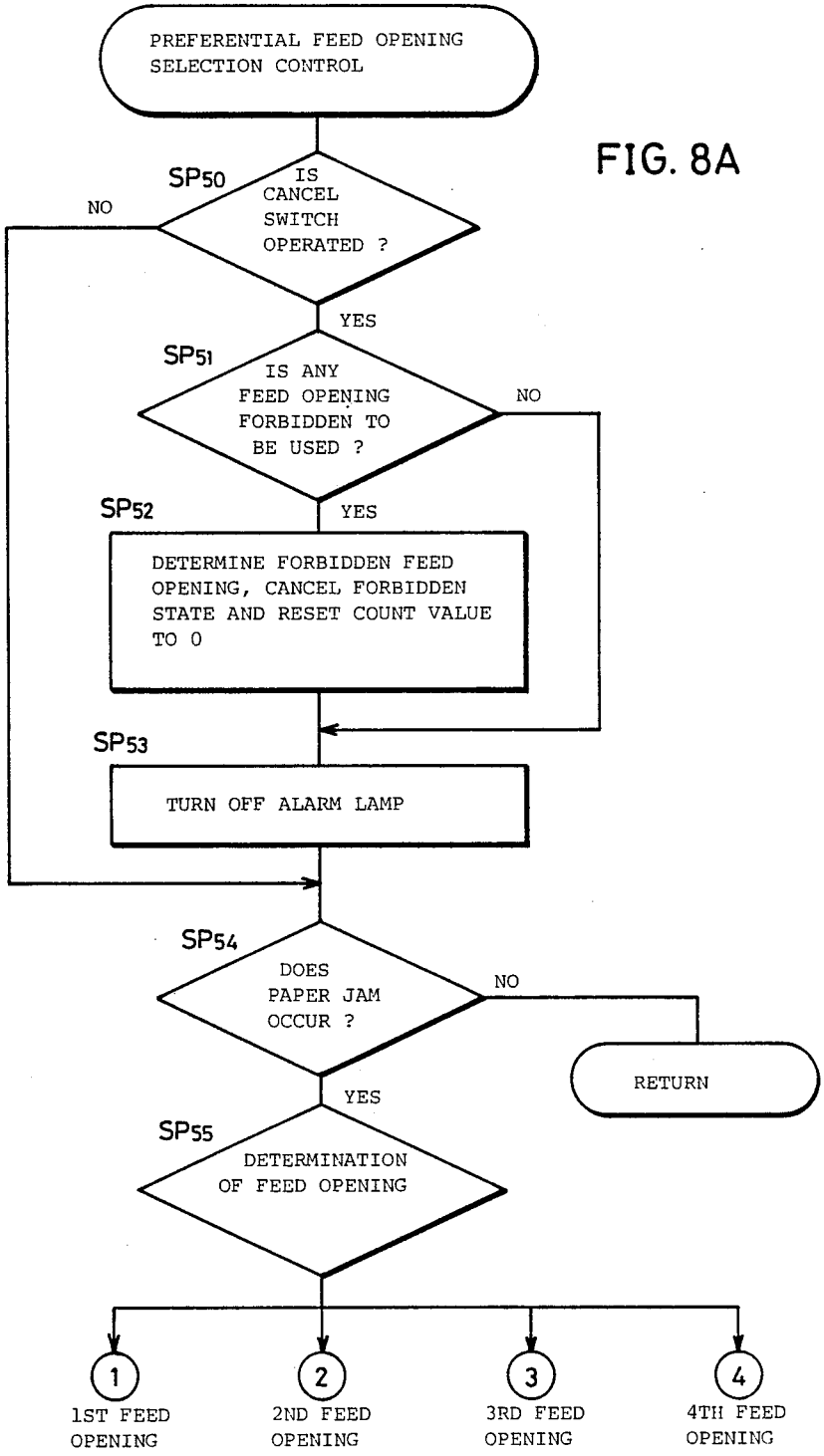
FIGS. 8A, 8B, and 8C are flow charts showing subroutine for preferential feed opening selection control as a step of a main routine of a control portion in still another embodiment of the present invention.
Figure 8B:
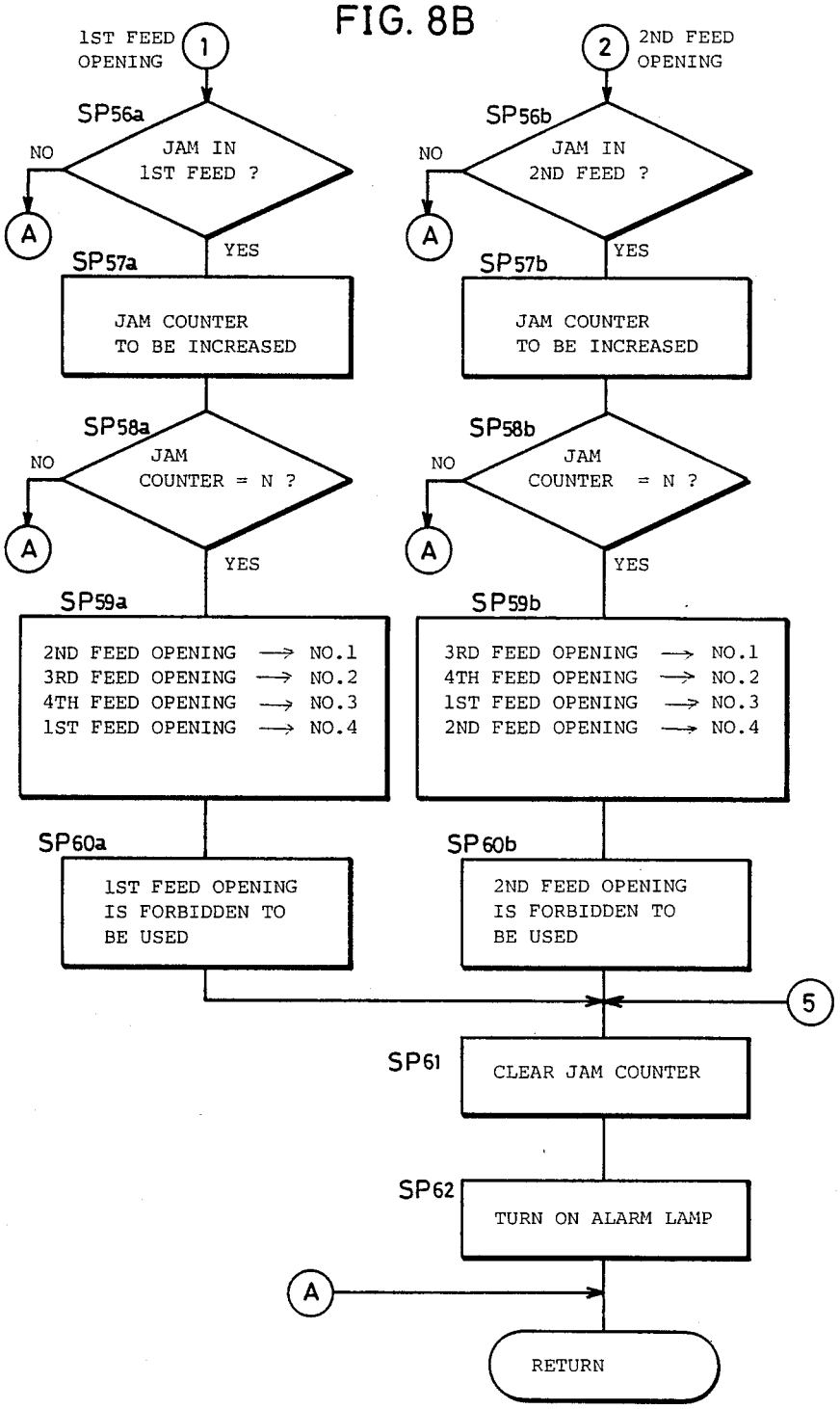
Figure 8C:
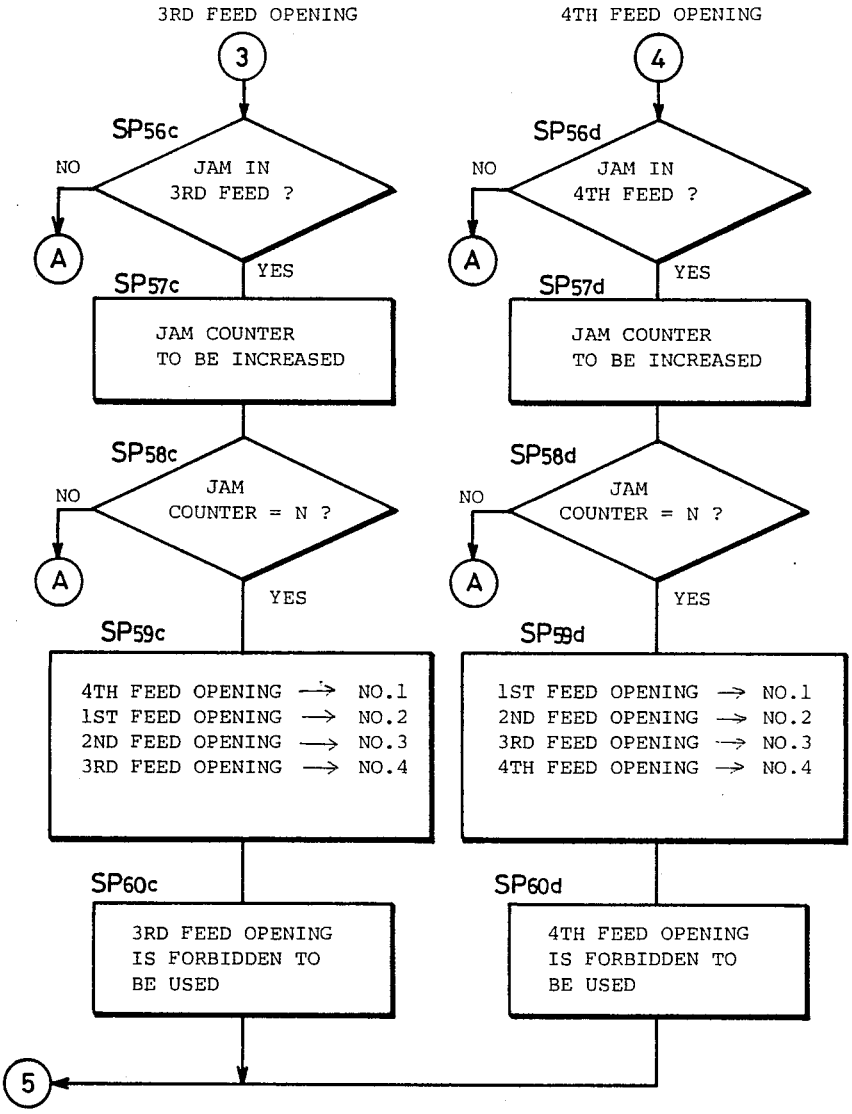

FIGS. 8A to 8C show flow charts in still another embodiment based on that control.

The step SP50 to SP54 of the subroutine shown in FIG. 8A are in principle the same as the steps SP10 to SP14 of the subroutine of FIG. 5A. If it is determined in the step SP54 that paper jam occurs, it is determined in the subsequent step SP55 which of the feed openings 1*a*, 1*b*, 1*c* and 1*d* is selected as the preferential feed opening. The data obtained by the determination is stored in the RAM 24.

If the first feed opening 1*a* is selected as the preferential feed opening, the steps SP56*a* to SP60*a* are executed. It is the same with the cases of the second feed opening 1*b*, the third feed opening 1*c* and the fourth feed opening 1*d*, in which the steps SP56*b* to SP60*b*, the steps SP56*c* to SP60 *c* and the steps SP56*d* to SP60*d*, respectively, are executed.

If the preferential feed opening is the first feed opening 1*a*, it is determined in the step SP56*a* whether the above stated paper jam is paper jam related with the first feed opening 1*a* or not. If not, the flow returns to the main routine to terminate the subroutine. If it is determined that paper jam occurs in the first feed opening 1*a* as the preferential feed opening, the jam counter is incremented in the subsequent step SP57*a*. This jam counter counts the number of occurred times of paper jam for only the feed opening designated as the preferential feed opening and the count value thereof is stored in the RAM 24. Then, in the step SP58*a*, it is determined whether the count value of the jam counter attains the predetermined number N or not. If it is smaller than the predetermined number N, that is, the number of occurred times of paper jam does not attain the predetermined number N, the flow returns to the main routine. If the count value attains the predetermined number N, the flow proceeds to the step SP59*a*. In the step SP59*a*, processing for changing the order of preference for selection of the feed openings is executed. More specifically, the initially set order of preference of the first feed opening 1*a*, the second feed opening 1*b*, the third feed opening 1*c* and the fourth feed opening 1*d* is changed to the order of preference of the second feed opening 1*b*, the third feed opening 1*c*, the fourth feed opening 1*d* and the first feed opening 1*a* and the data on the order of preference is stored in the RAM 24. Since the feed opening assigned the first priority is selected as the preferential feed opening, the preferential feed opening in this case is changed from the first feed opening 1*a* to the second feed opening 1*b*. In the subsequent step SP60*a*, the first feed opening 1*a* is forbidden to be used and then the flow proceeds to the step SP61.

Since it is the same with the cases of the second feed opening 1*b*, the third feed opening 1*c* and the fourth feed opening 1*d* being selected as the preferential feed opening, description thereof is omitted.

In the step SP61, the content of the above mentioned jam counter is reset to 0 and initialization processing for counting the number of occurred times of paper jam in the subsequent cycle is effected. Then, the alarm lamp 18 is turned on in the step SP62 and the flow returns to the main routine to terminate the subroutine.

Figure 9A:
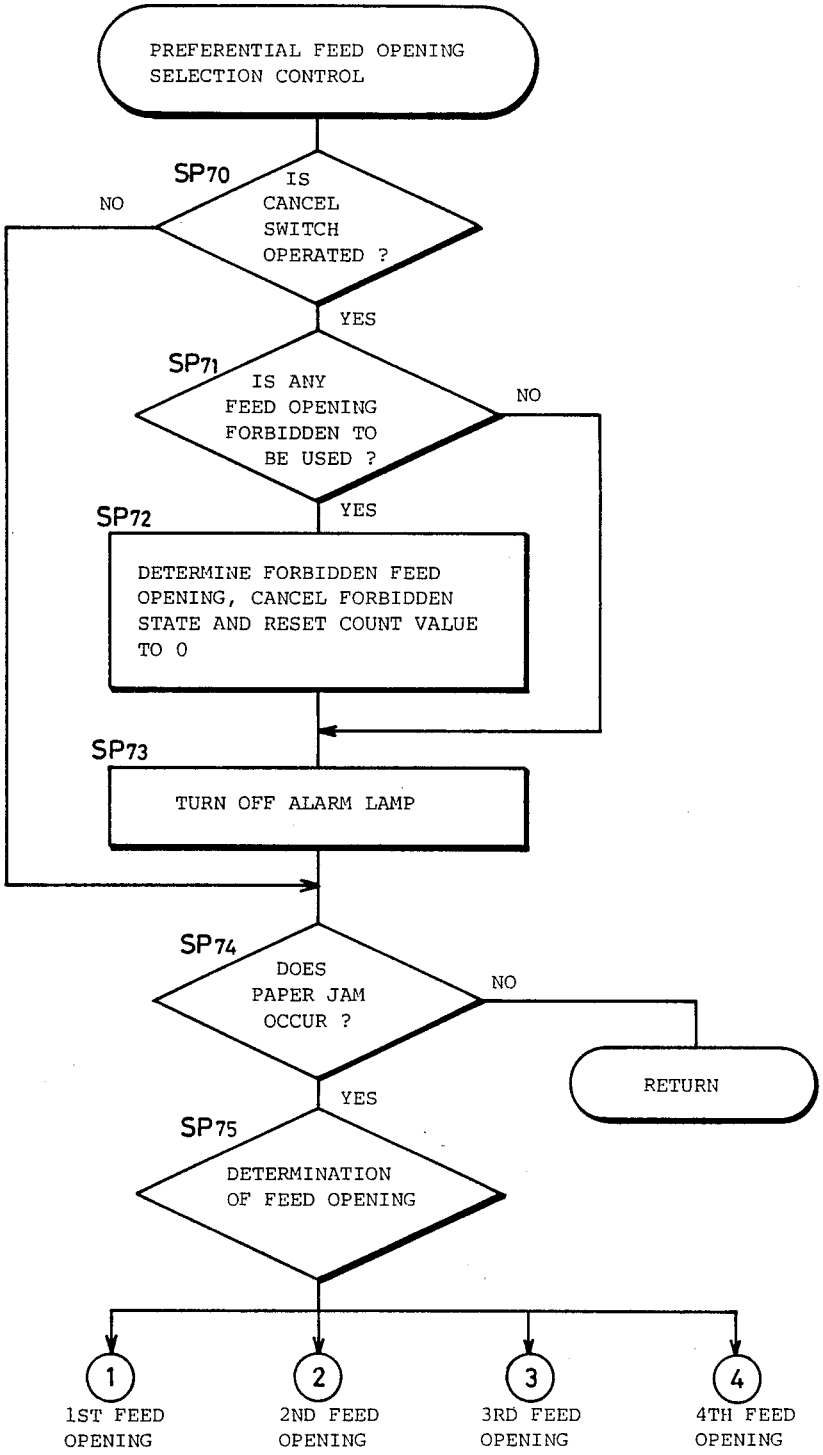
FIGS. 9A, 9B and 9C are flow charts showing subroutine for preferential feed opening selection control as a step of a main routine of a control portion in a further embodiment of the present invention.
Figure 9B:
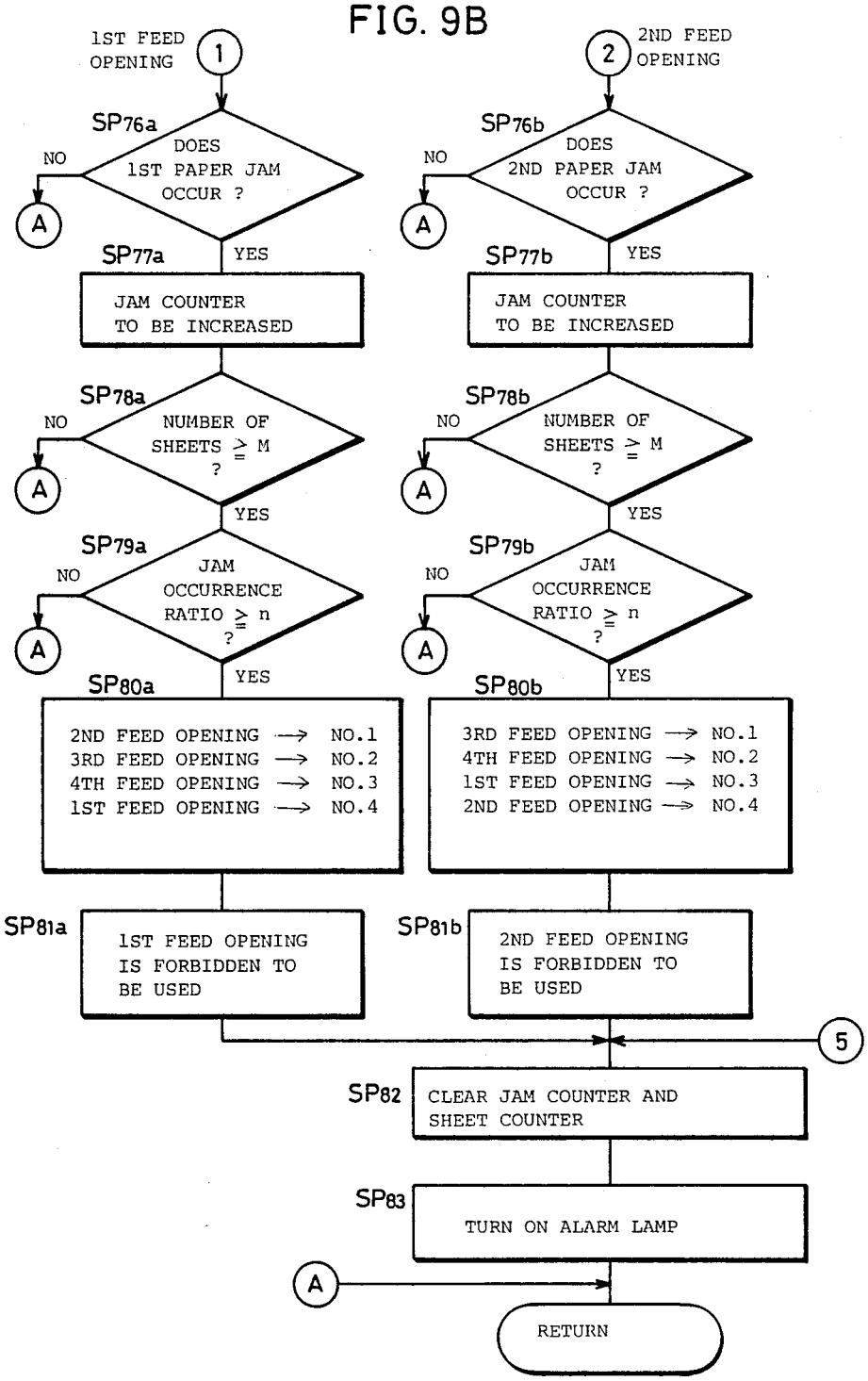
Figure 9C:
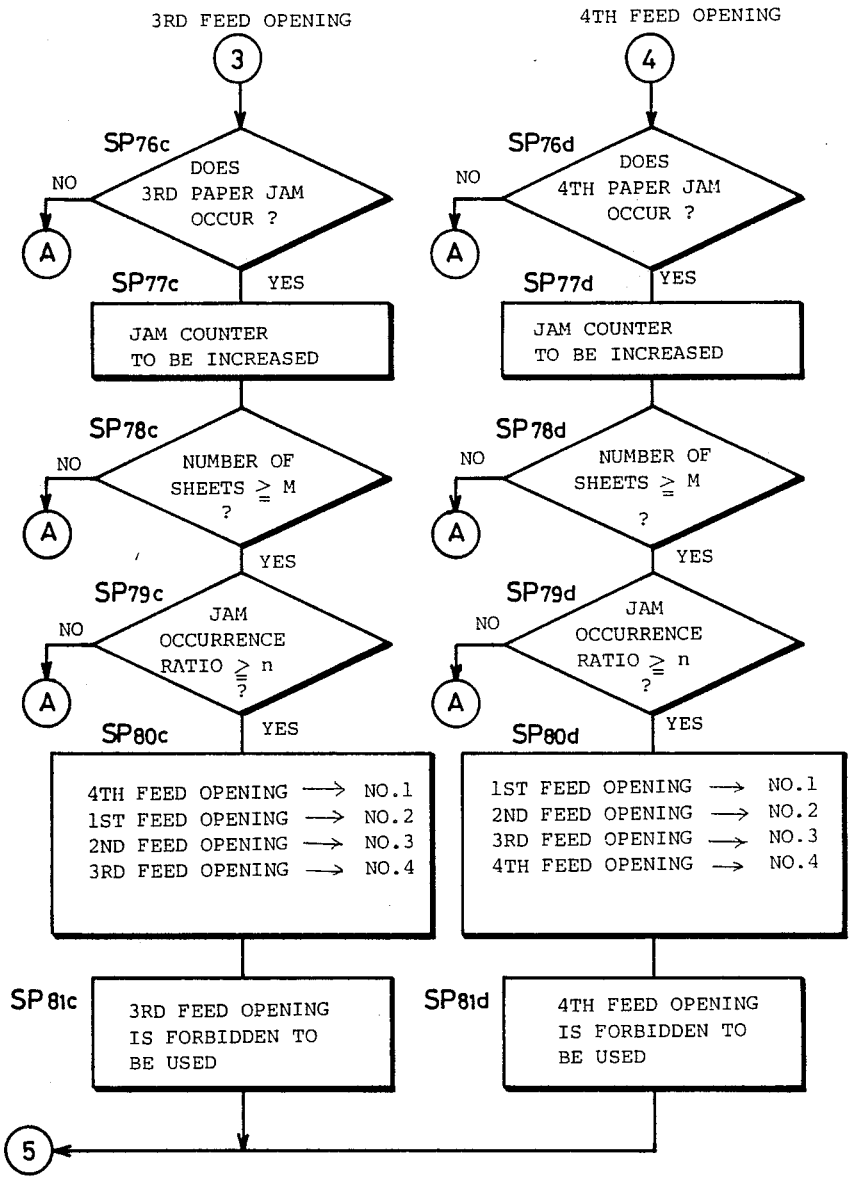

FIGS. 9A to 9C show subroutines in a further embodiment in which preferential feed opening selection control is effected based on calculation of the paper jam occurrence ratio for only the feed opening designated as the preferential feed opening.

The steps SP70 to SP74 of the subroutine shown in FIG. 9A are in principle the same as the steps SP10 to SP14 of the subroutine shown in FIG. 5A. If it is determined in the step SP74 that paper jam occurs, determination is made in the subsequent step SP75 as to which of the feed openings 1*a*, 1*b*, 1*c* and 1*d* is selected as the preferential feed opening. The data obtained by the determination is stored in the RAM 24.

If the first feed opening 1*a* is selected as the preferential feed opening, the steps SP76*a* to SP81*a* are executed. It is the same with the cases of the second feed opening 1*b*, the third feed opening 1*c* and the fourth feed opening 1*d*, in which the steps SP76*b* to SP81*b*, the steps SP76*c* to SP81*c* and the steps SP76*d* to SP81*d* are executed respectively.

If the preferential feed opening is the first feed opening 1*a*, it is determined in the step SP76*a* whether the above mentioned paper jam occurs in the first feed opening 1*a* or not. If not, the flow returns to the main routine to terminate the subroutine. If it is determined that the paper jam occurs in the first feed opening 1*a* as the preferential feed opening, the jam counter is incremented in the subsequent step SP77*a*. The jam counter counts the number of occurred times of paper jam related with only the feed opening designated as the preferential feed opening and the count value thereof is stored in the RAM 24. Then, in the step SP78*a*, it is determined whether the content of the sheet counter for counting the number of sheets fed from the preferential feed opening (the first feed opening in this case) attains the predetermined number M or not. If it does not attain M, the flow returns to the main routine to terminate the subroutine. If the number of sheets fed is equal to or larger than M, the flow proceeds to the step SP79*a* to determine whether the paper jam occurrence ratio is equal to or larger than the predetermined value n or not. If the paper jam occurrence ratio does not attain the predetermined value n, the flow returns to the main routine. If the paper jam occurrence ratio is equal to or larger than the predetermined value n, the flow proceeds to the step SP80*a*. In this step SP80*a*, processing for changing the order of preference for selection of the feed openings is executed. More specifically, the initially set order of preference, that is, the order of the first feed opening 1*a*, the second feed opening 1*b*, the third feed opening 1*c* and the fourth feed opening 1*d* is changed to the order of preference of the second feed opening 1*b*, the third feed opening 1*c*, the fourth feed opening 1*d* and the first feed opening 1*a* and the data on the order of preference is stored in the RAM 24. Since the feed opening of the first priority is selected as the preferential feed opening, it is changed in this case from the first feed opening 1*a* to the second feed opening 1*b*. In the subsequent step SP81*a*, use of the first feed opening 1*a* is forbidden and then the flow proceeds to the step SP82.

Since it is the same with the cases of the second feed opening 1*b*, the third feed opening 1*c* and the fourth feed opening 1*d* being initially selected as the preferential feed opening, description thereof is omitted.

In the step SP82, the content of the above mentioned jam counter and the content of the sheet counter are reset to 0 and initialization for calculating a paper jam occurrence ratio in the next cycle is effected. Then, in the step SP83, the alarm lamp 18 is turned on and after that the flow returns to the main routine to terminate the subroutine.

Figure 10:
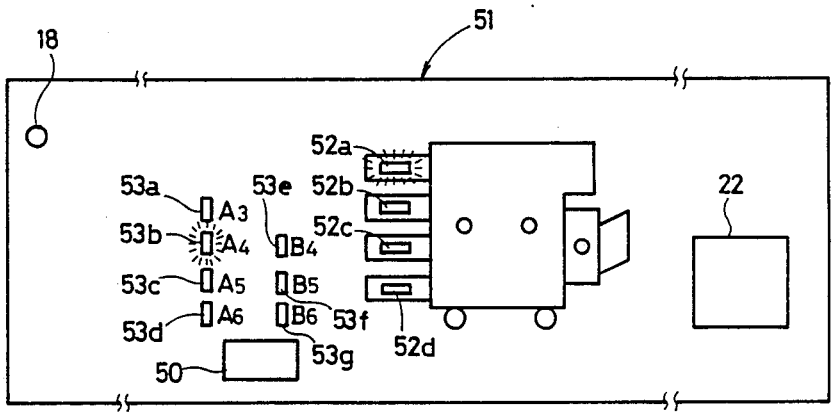
FIG. 10 is a plan view showing a part of an operation panel of a copying apparatus according to a still further embodiment of the present invention in which a feed opening selection switch of a rotation system and other elements are provided.

FIG. 10 shows an operation panel portion 51 in a still further embodiment of the present invention, which comprises a feed opening selection switch 50 of a rotation system for successively selecting the feed openings 1*a*, 1*b*, 1*c* and 1*d* by switching according to the order of preference. Thus, the present invention is also applicable to a copying apparatus comprising such feed opening selection switch 50 of the rotation system.

The operation panel portion 51 shown in FIG. 10 has the feed opening selection switch 50 of the rotation system, which is pressed to enable switching among the feed openings in the order of preference. There are further provided display lamps 52*a*, 52*b*, 52*c* and 52*d* to be turned on to display the selected feed openings corresponding thereto. The operation panel portion 51 further includes paper size display lamps 53*a* to 53*g* to be turned on to indicate which size of paper is contained in the corresponding one of the cassettes 2*a*, 2*b*, 2*c* and 2*d* attached to the selected one of the feed openings 1*a*, 1*b*, 1*c* and 1*d*.

In the case of FIG. 10, the first feed opening 1*a* is selected and the display lamp 52*a* corresponding thereto is illuminated with the paper size display lamp 53*b* being illuminated to indicate supply of the A4-size paper from the first feed opening 1*a*. The preferential feed opening (i.e., the feed opening of the first preference) is automatically selected when the main switch is turned on or the apparatus is automatically reset. Similarly to the case of FIG. 2, the operation panel portion 51 has other operation switches such as a print switch 22 and an alarm lamp 18 for indicating a forbidden state of the feed opening concerned.

Preferential feed opening selection control processing in the copying apparatus thus constructed is performed in the same manner as described above according to the flow charts shown in FIGS. 5A to 5C and 9A to 9C. More specifically, when the number of occurred times of paper jam or the paper jam occurrence ratio in the preferential feed opening exceeds a predetermined value, the order of preference is changed and the feed opening newly assigned the first priority can be selected as the preferential feed opening after the change and the use of the feed opening previously set as the preferential feed opening can be forbidden.

The present invention can be embodied in various manners in addition to the above described embodiments. For example, the present invention may be constructed in the following manner. If sheets of paper of the same size are contained in the plurality of cassettes and one of the cassettes is attached to the preferential feed opening, and when the number of occurred times of paper jam or the paper jam occurrence ratio in this preferential feed opening exceeds a predetermined value to require change of the preferential feed opening, then, a feed opening to which another cassette containing sheets of the same size is attached can be selected as the preferential feed opening. In addition, if the preferential feed opening is to be changed while cassettes are not attached to some feed openings, construction may be made in such a manner as to select the preferential feed opening among the feed openings to which cassettes are attached.

Further, although in the above described embodiments the feed opening where the number of occurred times of paper jam or the paper jam occurrence ratio exceeds the predetermined value is forbidden to be used, this feed opening may be assigned only the lowest priority, without being forbidden to be used.

In addition, in the case in which the preferential feed opening is to be changed with cassettes being not attached to some feed openings, even if a feed opening to which a cassette is not attached is selected as the feed opening of the first priority after the change, construction may be made in a manner in which that feed opening is not set as the preferential feed opening in the initial mode and the feed opening of the second priority is set as the preferential feed opening in the initial mode.

Since feed opening selection control processing is performed based on the occurrence of paper jam in the above described respective embodiments, it becomes possible to efficiently use the preferential feed opening in which paper jam occurs with the least possibility.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:
a plurality of paper feed means for feeding sheets of paper,
image forming means for forming an image on the sheet fed by said paper feed means,
counting means for counting the number of erroneous feeding operations occurring in each of said plurality of paper feed means,
first selection means for manually selecting any one of said plurality of paper feed means,
forbidding means for forbidding said first selection means to select the paper feed means in which the number of erroneous feeding operations counted by said counting means exceeds a predetermined number,
designation means for designating the paper feed means in which the number of erroneous feeding operations is the smallest out of the paper feed means the selection of which is not forbidden by said forbidding means, each time said forbidding means is operated,
initialization signal generating means, and
second selection means for selecting the paper feed means designated by said designation means, in response to the initialization signal from said initialization signal generating means.

2. An image forming apparatus in accordance with claim 1, further comprising
a power switch for turning on a power supply, wherein
said initialization signal generating means outputs the initialization signal in response to turn-on of said power switch.

3. An image forming apparatus in accordance with claim 1, wherein
said initialization signal generating means outputs the initialization signal after a lapse of a predetermined period from an end of operation of said image forming means.

4. An image forming apparatus in accordance with claim 1, further comprising
image formation instructing means for instructing a start of image forming operation, wherein
said initialization signal generating means outputs the initialization signal when said image formation instructing means is not enabled within a predetermined period after an end of operation of said first selection means.

5. An image forming apparatus in accordance with claim 1, further comprising
cancel means for cancelling forbidding of the selection of the paper feed means by said forbidding means and initializing a count value in said counting means.

6. An image forming apparatus in accordance with claim 1, further comprising
display means for indicating that said forbidding means is in operation.

7. An image forming apparatus comprising:
a plurality of paper feed means for feeing sheets of paper,
image forming means for forming an image on the sheet fed by said paper feed means,
counting means for counting the number of erroneous feeding operations occurring in each of said plurality of paper feed means,
initialization signal generating means, and
selection means for selecting the paper feed means in which the number of erroneous feeding operations counted by said counting means is the smallest, in response to the initialization signal from said initialization signal generating means.

8. An image forming apparatus comprising:
a plurality of paper feed means for feeding sheets of paper,
image forming means for forming an image on the sheet fed by said paper feed means,
counting means for counting the number of erroneous feeding operations occurring in each of said plurality of paper feed means,
designation means for designating one of said plurality of paper feed means according to a count value of said counting means,
initialization signal generating means, and
selection means for selecting the paper feed means designated by said designation means, in response to the initialization signal from said initialization signal generating means.

9. An image forming apparatus comprising:
a plurality of paper feed means for feeding sheets of paper,
image forming means for forming an image on the sheet fed by said paper feed means,
selection means for selecting one of said plurality of paper feed means,
counting means for counting the number of erroneous feeding operations occurring in each of said plurality of paper feed means, and
forbidding means for forbidding said selection means to select the paper feed means in which the number of erroneous feeding operations counted by said counting means exceeds a predetermined number.

10. An image forming apparatus comprising:
a plurality of paper feed means for feeding sheets of paper,
image forming for forming an image on the sheet fed bu said paper feed means,
calculation means for calculating an erroneous feeding occurrence ratio in each of said plurality of paper feed means,
first selection means for manually selecting any one of said plurality of paper feed means,
forbidding means for forbidding said first selection means to select the paper feed means in which the erroneous feeding occurrence ratio calculated by said calculation means exceeds a predetermined value,
designation means for designating the paper feed means in which the erroneous feeding occurrence ratio is the smallest out of the paper feed means the selection of which is not forbidden by said forbidding means, each time said forbidding means is operated, initialization signal generating means, and second selection means for selecting the paper feed means designated by said designation means, in response to the initialization signal from said initialization signal generating means.

11. An image forming apparatus in accordance with claim 10, further comprising a power switch for turning on a power supply, wherein said initialization signal generating means outputs the initialization signal in response to turn-on of said power switch.

12. An image forming apparatus in accordance with claim 10, wherein said initialization signal generating means outputs the initialization signal after a lapse of a predetermined period from an end of operation of said image forming means.

13. An image forming apparatus in accordance with claim 10, further comprising image formation instructing means for instructing a start of image forming operation, wherein said initialization signal generating means outputs the initialization signal when said image formation instructing means is not enabled within a predetermined period after an end of operation of said first selection means.

14. An image forming apparatus in accordance with claim 10, further comprising cancel means for cancelling forbidding of the selection of the paper feed means by said forbidding means and initializing a value obtained by said calculation means.

15. An image forming apparatus in accordance with claim 10, further comprising display means for indicating that said forbidding means is in operation.

16. An image forming apparatus in accordance with claim 10, wherein said calculation means comprises first counting means for counting the number of sheets fed from each of said plurality of paper feed means, and second counting means for counting the number of erroneous feeding operations in each of said plurality of paper feed means, thereby to calculate the erroneous feeding occurrence ratio based on the number of sheets and the number of erroneous feeding operations counted by said first and second counting means, respectively.

17. An image forming apparatus in accordance with claim 16, wherein said calculation means does not calculate the erroneous feeding occurrence ratio when the number of sheets counted by said first counting means does not attain a predetermined number.

18. An image forming apparatus comprising:

a plurality of paper feed means for feeding sheets of paper, image forming means for forming an image on the sheet fed by said paper feed means, calculation means for calculating an erroneous feeding occurrence ratio in each of said plurality of paper feed means, initialization signal generating means, and selection means for selecting the paper feed means in which the erroneous feeding occurrence ratio calculated by said calculation means is the smallest, in response to an output signal from said initialization signal generating means.

19. An image forming apparatus comprising:

a plurality of paper feed means for feeding sheets of paper, image forming means for forming an image on the sheet fed by said paper feed means, calculation means for calculating an erroneous feeding occurrence ratio in each of said plurality of paper feed means, designation means for designating one of said plurality of paper feed means, based on a value calculated by said calculation means, initialization signal generating means, and selection means for selecting the feed means designated by said designation means, in response to the initialization signal from said initialization signal generating means.

20. An image forming apparatus comprising:

a plurality of paper feed means for feeing sheets of paper, image forming means for forming an image on the sheet fed by said paper feed means, selection means for selecting one of said plurality of paper feed means, calculation means for calculating an erroneous feeding occurrence ratio in each of said plurality of paper feed means, and forbidding means for forbidding said selection means to select the paper feed means in which the erroneous feeding occurrence ratio calculated by said calculation means exceeds a predetermined value.

21. An image forming apparatus comprising:

a plurality of paper feed means for feeding sheets of paper, image forming means for forming an image on the sheet fed by said paper feed means, first designation means for designating one of said plurality of paper feed means, initialization signal generating means, first selection means for selecting the paper feed means designated by said first designation means, in response to the initialization signal from said initialization signal generating means, counting means for counting the number of erroneous feeding operations occurring in the paper feed means designated by said first designation means, second designation means for designating a paper feed means different from the paper feed means selected by said first selection means, when the number of erroneous feeding operations in the paper feed means designated by said first designation means, counted by said counting means exceeds a predetermined number, and second selection means for selecting the paper feed means designated by said second designation means, in response to the initialization signal from said initialization signal generating means, irrespective of the designation by said first designation means.

22. An image forming apparatus in accordance with claim 21, wherein operation of said first selection means is forbidden when one of said paper feed means is designated by said second designation means.

23. An image forming apparatus in accordance with claim 21, further comprising third selection means for manually selecting an arbitrary one of said plurality of paper feed means, and forbidding means for forbidding said third selection means to select the paper feed means designated by said first designation means when the number of erroneous feeding operations in said paper feed means, counted by said counting means exceeds a predetermined number.

24. An image forming apparatus in accordance with claim 23, further comprising display means for indicating that said forbidding means is in operation.

25. An image forming apparatus in accordance with claim 21, further comprising cancel means for canceling designation of the paper feed means by said second designation means.

26. An image forming apparatus in accordance with claim 21, further comprising a power switch for turning on a power supply, wherein said initialization signal generating means generates the initialization signal in response to turn-on of said power switch.

27. An image forming apparatus in accordance with claim 21, wherein said initialization signal generating means generates the initialization signal after a lapse of a predetermined period from an end of operation of said image forming means.

28. An image forming apparatus in accordance with claim 21, further comprising image formation instructing means for instructing a start of image forming operation, wherein said initialization signal generating means outputs the initialization signal when said image formation instructing means is not enabled within a predetermined period after an end of operation of said first selection means.

29. An image forming apparatus in accordance with claim 21, wherein said counting means counts the number of erroneous feeding operations occurring in the paper feed means designated by said second designation means and said second designation means designates another different feed means when the number of erroneous feeding operations in the paper feed means designated by said second designation means exceeds a predetermined number.

30. An image forming apparatus comprising:

a plurality of paper feed means for feeding sheets of paper, image forming means for forming an image on the sheet fed by said paper feed means, designation means for designating a paper feed means to be preferentially used out of said plurality of paper feed means, counting means for counting the number of erroneous feeding operations in the paper feed means designated by said designation means, control means for controlling said designation means to designated a paper feed means different from the presently designated means when the count value by said counting means exceeds a predetermined value, initialization signal generating means, and selection means for selecting the paper feed means designated by said designation means, in response to the initialization signal from said initialization signal generating means.

31. An image forming apparatus comprising:

a plurality of paper feed means for feeding sheets of paper, image forming means for forming an image on the sheet fed by said paper feed means, first designation means for designating one of said plurality of paper feed means, initialization signal generating means, first selection means for selecting the paper feed means designated by said first designation means, in response to the initialization signal from said initialization signal generating means, calculation means for calculating an erroneous feeding occurrence ratio in the paper feed means designated by said first designation means, second designation means for designating a paper feed means different from the paper feed means designated by said first designation means, when the erroneous feeding occurrence ratio calculated by said calculation means exceeds a predetermined value, and second selection means for selecting the paper feed means designation by said second designation means, in response to the initialization signal from said initialization signal generating means, irrespective of the designation of said first designation means.

32. An image forming apparatus in accordance with claim 31, wherein operation of said first selection means is forbidden when one of said plurality of paper feed means is designated by said second designation means.

33. An image forming apparatus in accordance with claim 31, further comprising third selection means for manually selecting an arbitrary one of said plurality of paper feed means, and forbidding means for forbidding said third selection means to select the paper feed means designated by said first designation means when the erroneous feeding occurrence ratio in said paper feed means calculated by said calculation means exceeds a predetermined value.

34. An image forming apparatus in accordance with claim 31, further comprising display means for indicating that said forbidding means is in operation.

35. An image forming apparatus in accordance with claim 31, further comprising cancel means for canceling designation of the paper feed means by said second designation means.

36. An image forming apparatus in accordance with claim 31, further comprising a power switch for turning on a power supply, wherein said initialization signal generating means generates the initialization signal in response to turn-on of said power switch.

37. An image forming apparatus in accordance with claim 31, wherein said initialization signal generating means generates the initialization signal after a predetermined period from an end of operation of said image forming means.

38. An image forming apparatus in accordance with claim 31, further comprising image formation instructing means for instructing a start of image forming operation, wherein said initialization signal generating means, outputs the initialization signal when said image formation instructing means is not enabled within a predetermined period after an end of operation of said first selection means.

39. An image forming apparatus in accordance with claim 31, wherein said calculation means further calculates an erroneous feeding occurrence ratio of the paper feed means designated by said second designation means, and said second designation means designates another different feed means when the erroneous feeding occurrence ratio of the paper feed means designated by said second designation means exceeds a predetermined value.

40. An image forming apparatus in accordance with claim 31, wherein said calculation means comprises first counting means for counting the number of sheets fed from each of said plurality of paper feed means, and second counting means for counting the number of erroneous feeding operations in each of said plurality of paper feed means, thereby to calculate the erroneous feeding occurrence ratio based on the number of sheets and the number of erroneous feeding operations counted by said first and second counting means, respectively.

41. An image forming apparatus in accordance with claim 40, wherein said calculation means does not calculate the erroneous feeding occurrence ratio when the number of sheets counted by said first counting means does not attain a predetermined number.

42. An image forming apparatus comprising:

a plurality of paper feed means for feeding sheets of paper, image forming means for forming an image on the sheet fed by said feed means, designation means for designating paper feed means to be preferentially used out of said plurality of paper feed means, calculation means for calculating an erroneous feeing occurrence ratio in the paper feed means designated by said designation means, control means for controlling said designation means to designate a paper feed means different from the presently designated means when the erroneous feeding occurrence ratio calculated by said calculation means exceeds a predetermined value, initialization signal generating means, and selection means for selecting the paper feed means designated by said designation means, in response to the initialization signal from said initialization signal generating means.

43. An image forming apparatus comprising:

a plurality of paper feed means for feeding sheets of paper, image forming means for forming an image on the sheet fed by said paper feed means, counting means for counting the number of erroneous feeding operations occurring in each of said plurality of paper feed means, manual switch means for manually generating a switch signal, selection means for successively selecting said plurality of paper feed means in a predetermined order, in response to the output of said manual switch means, and control means for changing said predetermined order based on the count value of said counting means.

44. An image forming apparatus in accordance with claim 43, wherein said counting means counts individually the number of erroneous feeding operations occurring in each of said plurality of paper feed means and said control means changes said predetermined order when the number of erroneous feeding operations in any of said plurality of paper feed means exceeds a predetermined value.

45. An image forming apparatus in accordance with claim 43, wherein said counting means counts the number of erroneous feeding operations occurring in a specified one of said plurality of paper feed means and said control means changes said predetermined order when the number of erroneous feeding operations occurring in said specified paper feed means exceeds the predetermined value.

46. An image forming apparatus in accordance with claim 44 or claim 45, wherein the paper feed means where the number of erroneous feeding operations exceeds said predetermined value is excluded from the paper feed means on which the change of said predetermined order by said control means is based.

47. An image forming apparatus comprising:

a plurality of paper feed means for feeding sheets of paper, image forming means for forming an image on the sheet fed by said paper feed means, counting means for counting individually the number of erroneous feeding operations occurring in each of said plurality of paper feed means, manual switch means for manually generating a switch signal, and control means responsive to the output of said manual switch means for successively selecting said plurality of paper feed means in ascending order beginning with the paper feed opening in which the number of erroneous feeding operations counted by said counting means is the smallest.

48. An image forming apparatus comprising:

a plurality of paper feed means for feeding sheets of paper, image forming means for forming an image on the sheet fed by said paper feed means, calculation means for calculating an erroneous feeding occurrence ratio in each of said plurality of paper feed means, manual switch means for manually generating a switch signal, selection means responsive to the output of said manual switch mans for successively selecting said plurality of paper feed means in a predetermined order, and control means for changing said predetermined order based on a value calculated by said calculation means.

49. An image forming apparatus in accordance with claim 48, wherein said calculation means calculates individually the erroneous feeding occurrence ratio in each of said plurality of paper feed means and said control means changes said predetermined order when the erroneous feeding occurrence ratio in any of said plurality of paper feed means exceeds the predetermined value.

50. An image forming apparatus in accordance with claim 48, wherein said calculation means calculates the erroneous feeding occurrence ratio in a specified one of said plurality of paper feed means and said control means changes said predetermined order when the erroneous feeding occurrence ratio in said specified paper feed means exceeds the predetermined value.

51. An image forming apparatus in accordance with claim 49 or claim 50, wherein the paper feed means in which the erroneous feeding occurrence ratio exceeds said predetermined value is excluded from the paper feed means on which the change of said predetermined order by said control means is based.

52. An image forming apparatus comprising:

a plurality of paper feed means for feeding sheets of paper, image forming means for forming an image on the sheet fed by said paper feed means, calculation means for calculating an erroneous feeding occurrence ratio in each of said plurality of paper feed means, manual switch means for manually generating a switch signal, and control means responsive to the output of said manual switch means for successively selecting said plurality of paper feed means in ascending order beginning with the paper feed opening in which the erroneous feeding occurrence ratio calculated by said calculation means is the smallest.

* * * * *